US009679676B2

(12) United States Patent
Koide et al.

(10) Patent No.: US 9,679,676 B2
(45) Date of Patent: Jun. 13, 2017

(54) COPPER WIRE ROD AND MAGNET WIRE

(71) Applicant: MITSUBISHI MATERIALS CORPORATION, Tokyo (JP)

(72) Inventors: Masato Koide, Kagawa-gun (JP); Eiho Watanabe, Osaka (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days.

(21) Appl. No.: 14/419,398

(22) PCT Filed: Aug. 29, 2013

(86) PCT No.: PCT/JP2013/073154

§ 371 (c)(1),
(2) Date: Feb. 3, 2015

(87) PCT Pub. No.: WO2014/034782

PCT Pub. Date: Mar. 6, 2014

(65) Prior Publication Data

US 2015/0213921 A1 Jul. 30, 2015

(30) Foreign Application Priority Data

Aug. 31, 2012 (JP) ..... 2012-192136

(51) Int. Cl.
*C22C 9/00* (2006.01)
*C22F 1/08* (2006.01)
(Continued)

(52) U.S. Cl.
CPC ..... *H01B 7/00* (2013.01); *B21C 1/003* (2013.01); *B21C 1/02* (2013.01); *B21C 3/08* (2013.01);
(Continued)

(58) Field of Classification Search
CPC ..... C22F 1/08; B22D 11/004; B22D 11/005; B22D 11/1206; H01B 1/026; H01B 1/16;
(Continued)

(56) References Cited

U.S. PATENT DOCUMENTS 3,161,541 A * 12/1964 Holub ..... C08G 69/44 428/379
3,987,224 A * 10/1976 Brinkmann ..... B22D 11/005 164/473
(Continued)

FOREIGN PATENT DOCUMENTS

CN 1334155 A 2/2002
JP 57-005834 A 1/1982
(Continued)

OTHER PUBLICATIONS

Office Action mailed Dec. 21, 2015 for the corresponding Chinese Application No. 201380039894.9.
(Continued)

*Primary Examiner* — Scott Kastler
*Assistant Examiner* — Vanessa Luk
(74) *Attorney, Agent, or Firm* — Leason Ellis LLP

(57) ABSTRACT

A copper wire rod with an excellent surface quality and a magnet wire, in which the occurrence of blister defects is suppressed, are provided. The copper wire rod has a composition consisting of: more than 10 ppm by mass and 30 ppm by mass or less of P; 10 ppm by mass or less of O; 1 ppm by mass or less of H; and the balance Cu and inevitable impurities, wherein hydrogen concentration after performing a heat treatment at 500° for 30 minutes in vacuum is 0.2 ppm by mass or less. The magnet wire includes: a drawn wire material produced by using the copper wire rod; and an insulating film coating an outer periphery of the drawn wire material.

3 Claims, 5 Drawing Sheets

(51) Int. Cl.

| | |
|---|---|
| ***B22D 11/00*** | (2006.01) |
| ***H01B 1/02*** | (2006.01) |
| ***H01B 7/00*** | (2006.01) |
| ***C22F 1/00*** | (2006.01) |
| ***B21C 1/02*** | (2006.01) |
| ***B21C 1/00*** | (2006.01) |
| ***B21C 3/08*** | (2006.01) |
| ***B21C 9/00*** | (2006.01) |
| ***B22D 11/12*** | (2006.01) |
| ***H01B 13/00*** | (2006.01) |
| ***H01B 13/06*** | (2006.01) |

(52) U.S. Cl.
CPC ..... *B21C 9/00* (2013.01); *B22D 11/005* (2013.01); *B22D 11/1206* (2013.01); *C22C 9/00* (2013.01); *C22F 1/00* (2013.01); *C22F 1/08* (2013.01); *H01B 1/026* (2013.01); *H01B 13/00* (2013.01); *H01B 13/06* (2013.01)

(58) Field of Classification Search
CPC . H01B 1/22; H01B 5/104; H01B 5/14; H01B 17/62
See application file for complete search history.

(56) References Cited

U.S. PATENT DOCUMENTS 6,682,824 B1 * 1/2004 Koshiba ..... B22D 11/00 252/512
2005/0247384 A1 * 11/2005 Jacobsen ..... B22D 11/108 148/553
2006/0292029 A1 12/2006 Aoyama et al.
2008/0196550 A1 * 8/2008 Abe ..... B22D 1/00 75/641
2011/0120594 A1 * 5/2011 Uno ..... B32B 15/018 148/23

FOREIGN PATENT DOCUMENTS

| | | | | |
|---|---|---|---|---|
| JP | 58-179549 | A | | 10/1983 |
| JP | 06-212300 | A | | 8/1994 |
| JP | 06212300 | A | * | 8/1994 |
| JP | 2001-297629 | A | | 10/2001 |
| JP | 2007-38252 | A | | 2/2007 |
| JP | 2007-050440 | A | | 3/2007 |
| JP | 2010-174351 | A | | 8/2010 |
| JP | 2010-234442 | A | | 10/2010 |
| JP | 4593397 | B | | 12/2010 |
| WO | WO-2011/118009 | A | | 9/2011 |

OTHER PUBLICATIONS

Office Action mailed Oct. 13, 2015 for the corresponding Japanese Application No. 2012-192136.
International Search Report mailed Oct. 22, 2013 for the corresponding PCT Application No. PCT/JP2013/073154.
Notice of Allowance mailed Aug. 2, 2016 for the corresponding Japanese Patent Application No. 2012-192136.

* cited by examiner

COPPER WIRE ROD AND MAGNET WIRE

CROSS-REFERENCE TO RELATED PATENT APPLICATIONS

This application is a U.S. National Phase Application under 35 U.S.C. §371 of International Patent Application No. PCT/JP2013/073154, filed Aug. 29, 2013, and claims the benefit of Japanese Patent Applications No. 2012-192136, filed on Aug. 31, 2012, all of which are incorporated by reference in their entirety herein. The International Application was published in Japanese on Mar. 6, 2014 as International Publication No. WO/2014/034782 under PCT Article 21(2).

FIELD OF THE INVENTION

The present invention relates to: a copper wire rod, for example, used for the wire such as the magnet wire or the like of a motor; and a magnet wire using the copper wire rod.

BACKGROUND OF THE INVENTION

Conventionally, as the above-mentioned copper wire rod, one made of the tough-pitch copper is broadly used. However, the tough-pitch copper cannot be used in such a case where the magnet wire is used by welding since the tough-pitch copper includes oxygen (O) at 0.02-0.05 mass % causing the hydrogen embrittlement. Therefore, in the use where welding is performed, the copper wire rod, which is made of copper with a low oxygen content such as the oxygen-free copper or the like whose oxygen content is 10 ppm or less by mass ppm, is used.

The above-mentioned copper wire rod is produced by dip forming or extruding. In the dip forming, the copper wire rod is obtained by continuously solidifying molten copper around a copper seed wire to obtain a rod-shaped copper material; and rolling. In the extruding, the copper wire rod is obtained by subjecting the copper billet to extruding; and performing rolling or the like. However, production efficiency is poor in these production methods increasing production cost.

As copper wire rod production methods with low production cost, there is the method by continuous casting and rolling using the belt-wheel type continuous casting apparatus and the continuous rolling device as described in Japanese Unexamined Patent Application, First Publication No. 2007-50440 (A), for example. In this continuous casting and rolling method, the molten copper, which is melted in a large-sized melting furnace such as the shaft furnace, is converted to an ingot by cooling and solidifying; and the ingot is subjected to continuous withdrawing and rolling. In this method, mass-production is possible by using a large-scale facility.

However, when copper with low oxygen content is melted, hydrogen concentration in the molten copper increases and water vapor bubbles are formed. Then, holes are formed in the ingot due to difficulty of the above-mentioned formed bubbles to be released from the bath level since the mold is in revolving movement in the belt-wheel type continuous casting apparatus.

It is believed that the above-mentioned holes residing in the ingot are the main cause of the surface defects in the copper wire rod. The surface defects of the copper wire rod also causes surface defects of the drawn wire material when the copper wire rod is subjected to a drawing process to be a drawn wire material. When such a drawn wire material is used for the conductor of the magnet wire and an enamel coat (insulating film) is applied on the surface of the drawn wire material, moisture or oil residing in the surface defect of the drawn wire material is trapped by the enamel coat. In this case, it causes a problem refereed "blister defect" formation, in which a bubble is generated and swollen in the enamel coat during heating after drying.

In order to suppress the formation of the blister defect, the copper wire rod, which is produce by adding a P-compound to the molten copper in such a way that the phosphorous (P) content of the ingot is set to 1-10 ppm and adjusting the temperature of the molten copper to 1085° C.-1100° C., is disclosed in Japanese Patent (Granted) Publication No. 4593397 (B), for example.

Problems to be Solved by the Invention

However, suppression of bubble generation by water vapor ($H_2O$) was not sufficient in the copper wire rod disclosed in Japanese Patent (Granted) Publication No. 4593397 (B), since the P content is set to 1-10 ppm, which is low, and O in the copper melt during casting cannot be fixed by P sufficiently. Because of this, generation of the holes in the ingot cannot be suppressed and the surface defects formed in the copper wire rod cannot be sufficiently reduced.

The present invention was made under the circumstances described above. The purpose of the present invention is to provide a copper wire rod with an excellent surface quality and a magnet wire, in which formation of the blister defect is suppressed.

SUMMARY OF THE INVENTION

Means for Solving the Problem

The inventors of the present invention conduct extensive study to solve the above-described problem and found the $H_2O$ (water vapor) generation can be suppressed and generation of holes in the ingot can be suppressed effectively during casting in continuous casting and rolling, by fixing O in the melt with P: by setting the O content to 10 ppm by mass or less; and by adding more than 10 ppm by mass and 30 ppm by mass or less of P.

Under the situation described above, there are plenty of free hydrogens that were not reacted with O in the copper wire rod consequently. When a heat treatment at 500° C. for 30 minutes in vacuum is performed on the copper wire rod obtained as described above, the above-mentioned free hydrogens are released outside from the copper wire rod; and the hydrogen content of the copper wire rod becomes 0.2 ppm by mass or less.

The present invention was made based on the above-described findings and has aspects shown below.

An aspect of the present invention is a copper wire rod (hereinafter referred as "the copper wire rod of the present invention") including a composition consisting of: more than 10 ppm by mass and 30 ppm by mass or less of P; 10 ppm by mass or less of O; 1 ppm by mass or less of H; and the Cu balance and inevitable impurities, wherein hydrogen concentration after performing a heat treatment at 500° for 30 minutes in vacuum is 0.2 ppm by mass or less.

According to the copper wire rod of the present invention, the hydrogens in the copper wire rod exist as free hydrogen, since the P content is set to more than 10 ppm by mass and 30 ppm by mass or less; the hydrogen concentration after performing the heat treatment at 500° C. for 30 minutes in vacuum is set to 0.2 ppm by mass or less. Therefore, the holes due to $H_2O$ are absent in the copper wire rod; and formation of the surface defects can be suppressed.

A magnet wire that is other aspect of the present invention (hereinafter referred as "the magnet wire of the present invention") is a magnet wire including: a drawn wire material produced by using the above-mentioned copper wire rod of the present invention; and an insulating film coating an outer peripheral of the drawn wire material.

According to the magnet wire of the present invention, formation of surface defects of the drawn wire material is suppressed; and formation of blister defects in the magnet wire can be suppressed, since the drawn wire material, which is produced by using the copper wire rod with excellent surface quality as explained above, is used in the magnet wire.

Effects of the Invention

According to the present invention, a copper wire rod with excellent surface quality and a magnet wire in which formation of blister defects is suppressed can be provided.

DETAILED DESCRIPTION OF THE INVENTION

Best Mode for Carrying Out the Invention

The copper wire rod and the magnet wire related to embodiments of the present invention are explained below.

Figure 1:
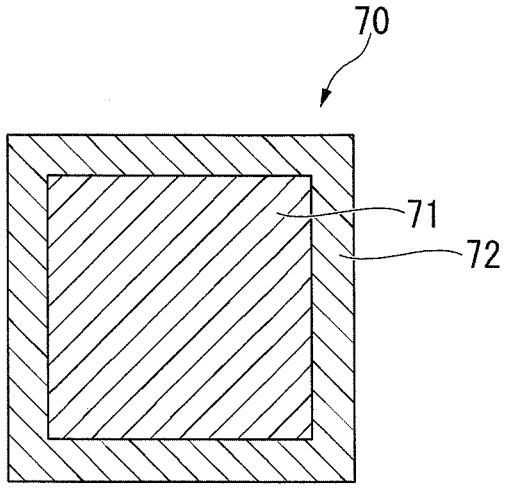
FIG. 1 is a cross-sectional view of a magnet wire related to an embodiment of the present invention.

The copper wire rod 60 related to the present embodiment is used as a raw material of the magnet wire 70 shown in FIG. 1, for example. First, the magnet wire 70 related to the present embodiment is explained.

The magnet wire 70 includes the drawn wire material 71, which is produced by drawing process on the copper wire rod 60, and the enamel coat 72 (insulating film), which coats the drawn wire material 71, as shown in FIG. 1. In the present embodiment, the drawn wire material 71 is a rectangular wire. Specifically, the magnet wire 70 is used as the magnet wire for a motor.

Next, the copper wire rod 60 related to the present embodiment is explained.

The copper wire rod 60 has a composition made of: more than 10 ppm by mass and 30 ppm by mass or less of P; 10 ppm by mass or less of O; 1 ppm by mass or less of H; and the Cu balance and inevitable impurities. In addition, in the copper wire rod 60, hydrogen concentration after performing a heat treatment at 500° C. for 30 minutes in vacuum is 0.2 ppm by mass or less. In the present embodiment, the heat treatment is performed in vacuum of $1\times10^{-10}$ Torr.

The hydrogen concentration in the copper wire rod 60 is measured by the inert gas fusion gas chromatography-separated thermal conductivity measurement method using the hydrogen analyzer manufactured (model: RHEN-600) by LECO Co. Ltd. In the hydrogen analyzer (RHEN-600), the lower limit of quantification of the method of the hydrogen concentration measurement is 0.2 ppm by mass. The lower limit of quantification of the method means the lower limit value at which the hydrogen concentration is measured accurately in the analysis method.

Preferably, the copper wire rod 60 is fully softened by annealing after cold working with cross-section reduction rate of 20% or more. In this copper wire rod 60, it is preferable that crystals, <111> orientations of which are oriented within the range of ±10° with respect to the drawing direction of the copper wire, is 30% or less of the all crystals in the cross-section perpendicular to the drawing direction of the copper wire.

In addition, preferably, the copper wire rod 60 is fully softened after working with the cross-section reduction rate of 20% or more. In the crystal orientations of this copper wire rod 60, it is preferable that: the crystals, <100> orientations of which are oriented within the range of ±10° with respect to the drawing direction of the copper wire, is 10% or more of the all crystals; and the crystals, <111> orientations or <112> orientations of which are oriented within the range of ±10° with respect to the drawing direction, is 30% or less of the all crystals. In addition, it is preferable that the electrical conductivity of the copper wire rod 60 is 100% IACS (International Annealed Copper Standard) or more.

The orientations of the crystals can be measured by Electron Back Scatter Diffraction Patterns method (EBSD method). In EBSD method, SEM (Scanning Electron Microscope) is connected to EBSD detector. In EBSD method, the orientations of diffracted images (EBSD) of each of crystals are analyzed, the diffracted images being generated when convergent electron beam is irradiated on a surface of a sample, and the crystal orientations of the material is measured based on the orientation data and the positional information of the measurement locations. The measurement result is presented as the crystal orientation map (IPF Map).

Figure 2:
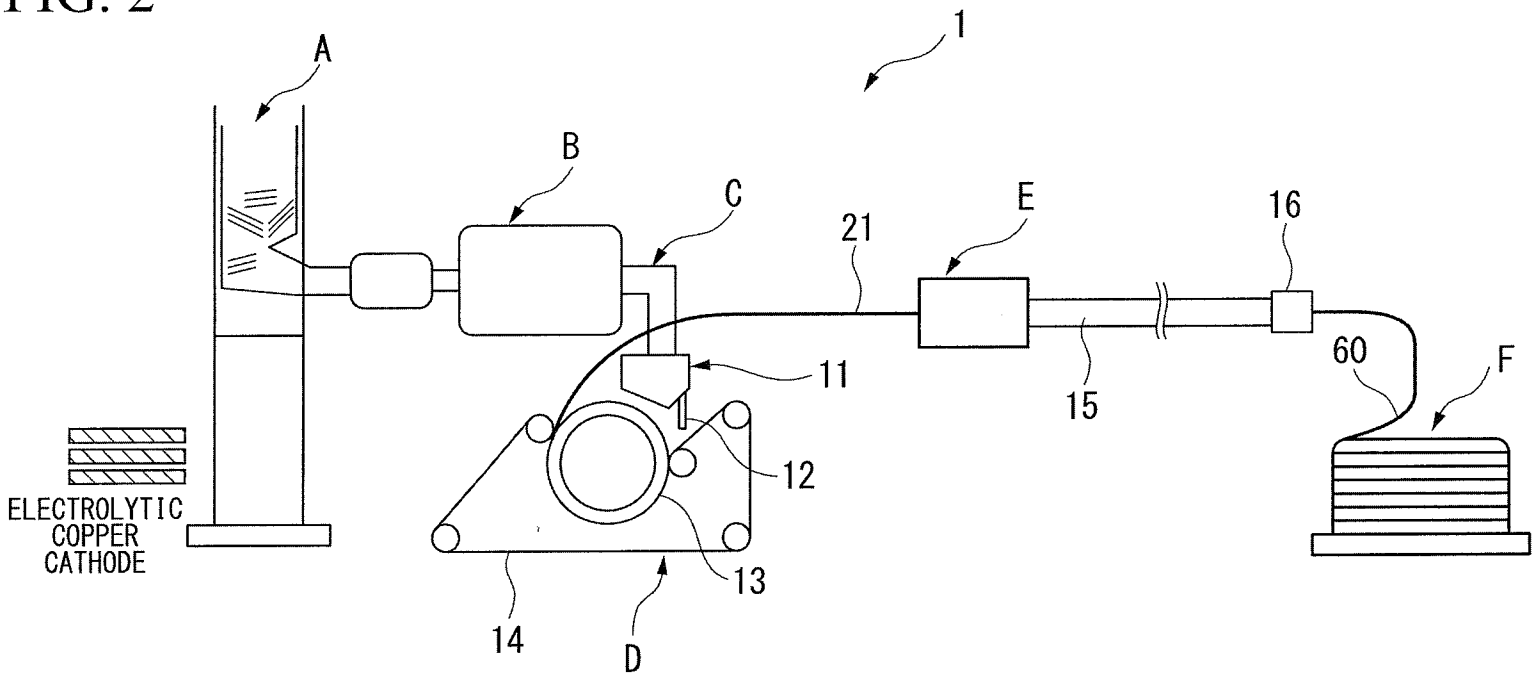
FIG. 2 is a schematic illustration of a production apparatus for producing a copper wire rod related to an embodiment of the present invention.

Next, the copper wire rod producing apparatus 1 for producing the copper wire rod related to the present embodiment is explained below. The schematic illustration of the production apparatus is shown in FIG. 2.

The copper wire rod producing apparatus 1 includes: the melting furnace A; the holding furnace B; the casting launder C; the belt-wheel type continuous casting apparatus D; the continuous rolling device E; and the coiler F.

The shaft furnace having the cylindrical main body of the furnace is used in the present embodiment as the melting furnace A.

Multiple burners (not shown in drawings) are provided below the main body of the furnace in the circumferential direction in a multi-staged fashion vertically. The electrolytic copper cathode, which is the raw material, is fed from the upper part of the main body of the furnace. Then, the electrolytic copper cathode is melt by combustion in the above-mentioned burners, allowing continuous production of molten copper.

The holding furnace B is for: temporary retaining the molten copper produced in the melting furnace A while retaining the molten copper at a predetermined temperature; and sending a fixed amount of the molten copper to casting launder C.

The casting launder C is for transferring the molten copper sent from the holding furnace B to the tundish 11 provided above the belt-wheel type continuous casting apparatus D.

The pouring nozzle 12 is provided to the end side of the flow direction of the molten copper of the tundish 11. The molten copper in the tundish 11 is supplied to the belt-wheel type continuous casting apparatus D through this pouring nozzle 12.

The belt-wheel type continuous casting apparatus D includes: the casting wheel 13 in which a groove if formed in the wheel's outer circumference; and the endless belt 14 which makes circular movement in such a way that the endless belt 14 touches a part of the outer circumference of the casting wheel 13. The molten copper, which is supplied through the pouring nozzle 12, is poured into the space formed between the above-mentioned groove and the endless belt 14 to cool the molten copper. The long length ingot 21 is continuously casted by following the above-described processes.

The belt-wheel type continuous casting apparatus D is connected to the continuous rolling device E.

The continuous rolling device E is for: continuously rolling the long length ingot 21 produced in the belt-wheel type continuous casting apparatus D as the work material to be rolled 22; and producing the copper wire rod 60 with a predetermined outside diameter. The copper wire rod 60 produced in the continuous rolling device E is reeled by the coiler F thorough the cleaning and cooling device 15 and the flaw detector 16.

The cleaning and cooling device 15 is for: cleaning the surface of the copper wire rod 60 produced in the continuous rolling device E with a cleaning agent such as alcohol or the like; and cooling the copper wire rod 60.

The flaw detector 16 is for detecting flaws (defects) of the copper wire rod 60 transferred from the cleaning and cooling device 15.

Next, the continuous rolling device E is explained. The continuous rolling device E utilized in the copper wire rod producing apparatus 1 related to the present embodiment is shown in FIG. 3.

Figure 3:
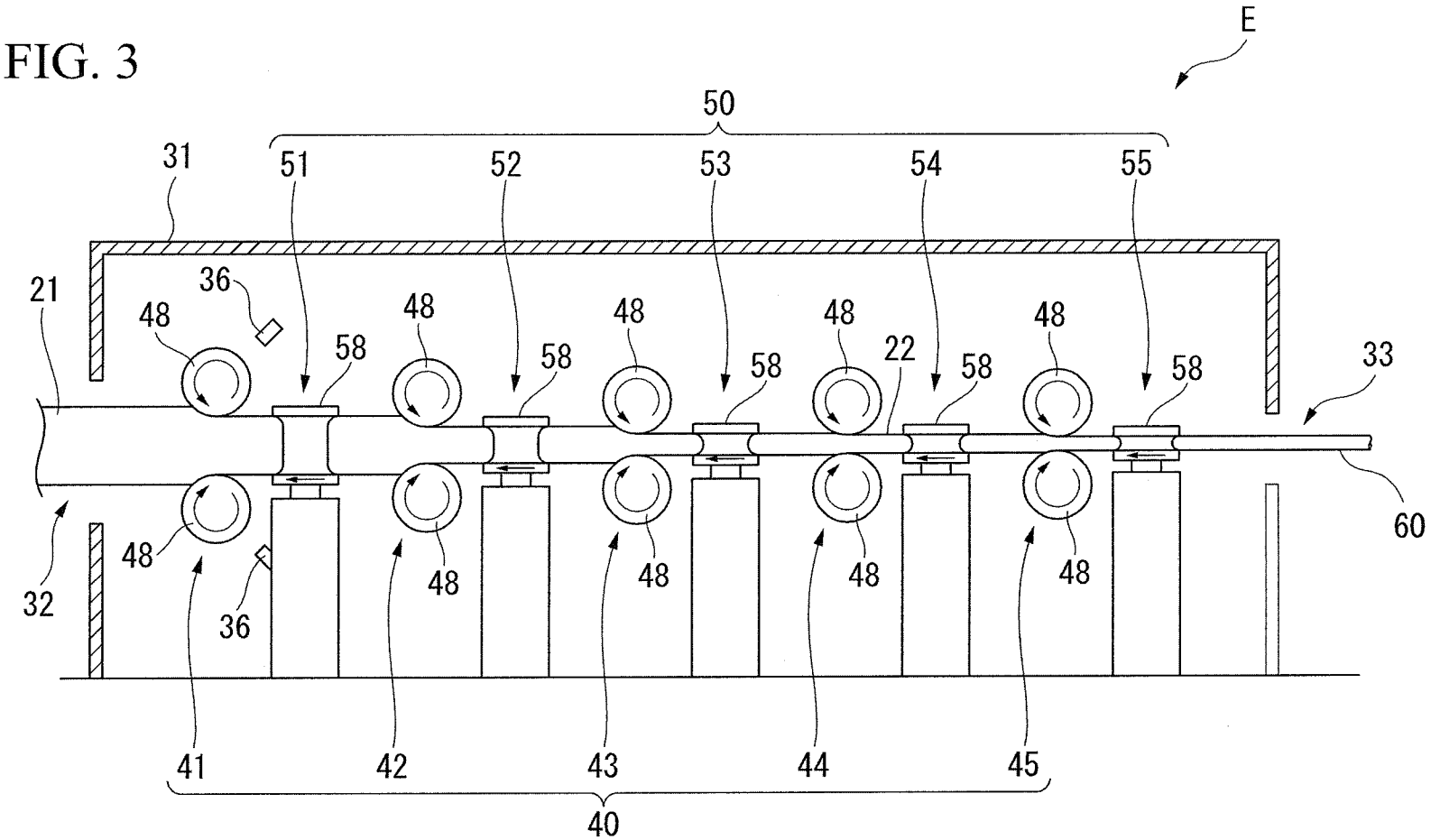
FIG. 3 is a cross-sectional view of a continuous rolling device provided to the production apparatus of the copper wire rod shown in FIG. 2.

As shown in FIG. 3, the continuous rolling device E includes the cover part 31. The feeding inlet 32 for feeding the long length ingot 21 is formed on one end side of the cover part 31 (left side in FIG. 3). On the other end side of the cover part 31 (right side in FIG. 3), the product outlet 33 where the produced copper wire rod 60 is output is formed.

The continuous rolling device E also includes: the vertical rolling unit 40, which has a pair of the vertical mill rolls 48 arranged facing each other in the vertical direction; and the horizontal rolling unit 50, which has a pair of the horizontal mill rolls 58 arranged facing each other in the horizontal direction, in the inside of the cover part 31.

Five sets of the vertical rolling units 40, each of which has the pair of the vertical mill rolls 48, are placed to the continuous rolling device E. The five sets are: the first vertical rolling unit 41; the second vertical rolling unit 42; the third vertical rolling unit 43; the fourth vertical rolling unit 44; and the fifth vertical rolling unit 45, from the side of the feeding inlet 32 in order. The nozzles 36 for spraying rolling oil on the rolling surface are provided to the first vertical rolling unit 41.

Five sets of the horizontal rolling unit 50, each of which has the pair of the horizontal mill rolls 58, are placed to the continuous rolling device E. The five sets are: the first horizontal rolling unit 51; the second horizontal rolling unit 52; the third horizontal rolling unit 53; the fourth horizontal rolling unit 54; and the fifth horizontal rolling unit 55, from the side of the feeding inlet 32 in order.

The vertical mill roll 48 is supported in such a way that the vertical mill roll 48 rotates on the vertical surface along the travelling direction of the work material to be rolled 22. The vertical mill roll 48 is rotary driven in the direction indicated by the arrow shown in FIG. 3 by a power source not shown in the drawing. The vertical mill rolls 48 form each pair and sandwich the work material to be rolled 22 in the vertical direction to roll the work material to be rolled 22. The rotation speed of each of the vertical mill rolls 48 of the first to fifth vertical rolling units 41-45 can be controlled individually.

The horizontal mill roll 58 is supported in such a way that the horizontal mill roll 58 rotates on the horizontal surface along the travelling direction of the work material to be rolled 22. The horizontal mill roll 58 is rotary driven in the direction indicated by the arrow shown in FIG. 3 by a power source not shown in the drawing. The horizontal mill rolls 58 form each pair and sandwich the work material to be rolled 22 in the horizontal direction to roll the work material to be rolled 22. The rotation speed of each of the horizontal mill rolls 58 of the first to fifth horizontal rolling units 51-55 can be controlled individually.

The method of producing the copper wire rod and the method of producing the magnet wire, in both of which the copper wire rod producing apparatus 1 configured as explained above is used, are explained below in reference to FIGS. 2 to 5.

First, the 4N electrolytic copper cathode (purity: 99.99%) is introduced and melted to obtain the molten copper (Melting Step S1). In this melting step S1, the inside of the melting furnace A is set to be a reducing atmosphere by adjusting the air-fuel ratio of the multiple burners of the shaft furnace.

The molten copper is transferred to the tundish 11 through the casting launder C while being retained at a predetermined temperature after being sent to the holding furnace B.

In the present embodiment, the agitating device is provided in the flow passage of the molten copper in the casting launder C as a de-gassing device for de-oxidation and de-hydrogenation to perform de-gassing (De-gassing Step S2). The agitating device is constituted from multiple weirs and the molten copper flows through the weirs while being agitated vigorously. The agitating device is provided for performing de-hydrogenation mainly. However, by being agitated, even oxygen residing in the molten copper is de-oxidized. By performing the processes described above, the oxygen (O) content is set to 10 ppm by mass or less; and the hydrogen (H) content is set to 1 ppm by mass or less, in the molten copper.

Then, P is added to the molten copper in the tundish 11 to set the P content in the molten copper to more than 10 ppm by mass and 30 ppm by mass or less (P-Adding Step S3). It is preferable that the molten copper is retained at the temperature 1085° C. or higher and 1115° C. or lower.

After the P-adding step, the molten copper is supplied from the tundish 11 to the space (mold) formed between the casting wheel 13 of the belt-wheel type continuous casting apparatus D and the endless belt 14 through the pouring nozzle 12. Then, it is cooled to produce the long length ingot 21 (Continuous Casting Step S4). In the present embodiment, the produced long length ingot 21 has the substantially trapezoidal cross-sectional shape with: width of about 100 mm; and height of about 50 mm.

The long length ingot 21 continuously produced by the belt-wheel type continuous casting apparatus D is supplied to the continuous rolling device E. The long length ingot 21 is inserted from the feeding inlet 32 of the continuous rolling device E as the work material to be rolled 22. The inserted long length ingot 21 is first subjected to the initial rolling by the first vertical rolling unit 41 and the first horizontal rolling unit 51. Then, it is subjected to continuous rolling by: the second vertical rolling unit 42 and the second horizontal rolling unit 53; the third vertical rolling unit 43 and the third horizontal rolling unit 53; the fourth vertical rolling unit 44 and the fourth horizontal rolling unit 54; and the fifth vertical rolling unit 45 and the fifth horizontal rolling unit to output the copper wire rod 60 with the predetermined outside diameter (diameter of 8.0 mm in the present embodiment) from the product outlet 33 (Continuous Rolling Step S5).

Figure 4:
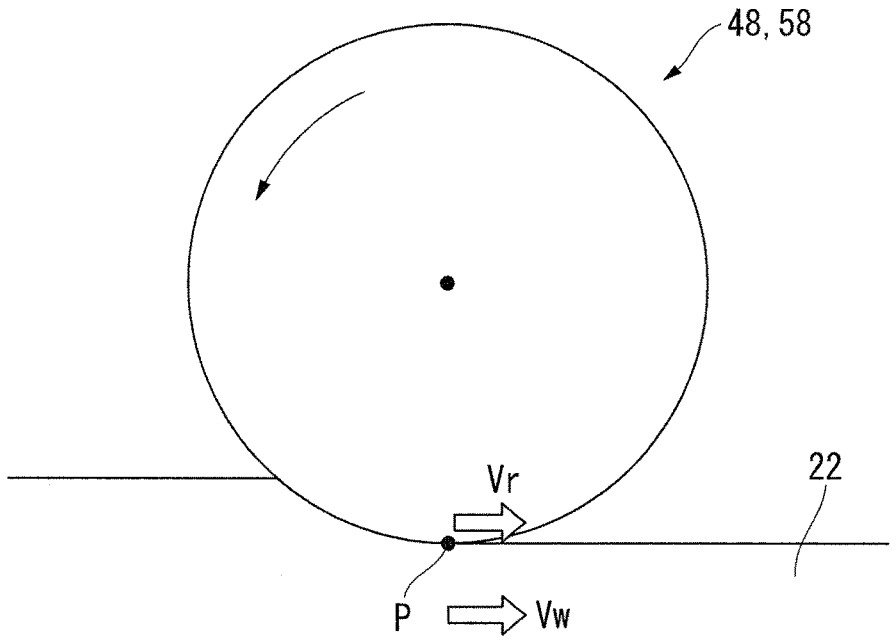
FIG. 4 is an enlarged schematic view indicating a rolled part in a work to be rolled by a mill roll provided to the continuous rolling device shown in FIG. 3.
Figure 5:
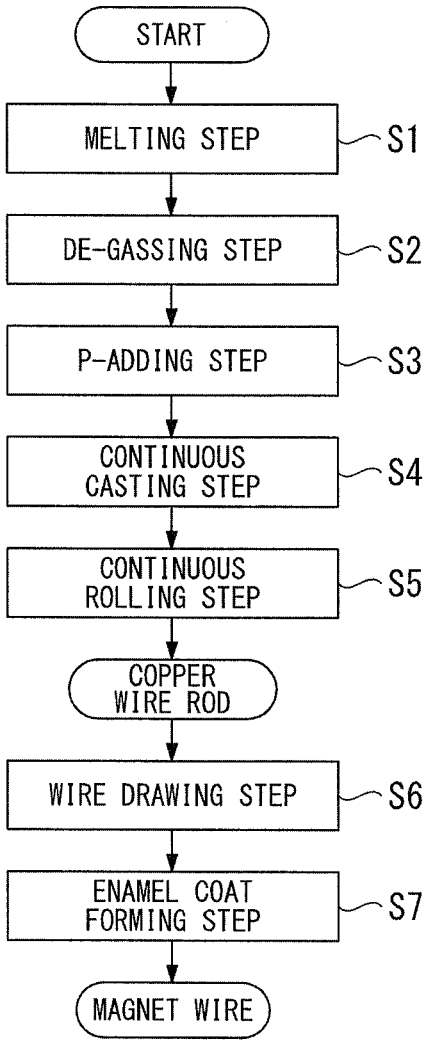
FIG. 5 is a flow chart of a method of producing the copper wire rod and the magnet wire, both of which relate to embodiments of the present invention.

In the continuous rolling step S5, the output speed of the long length ingot 21; and the rotation speeds of the vertical mill roll 48 and the horizontal mill roll 58, are controlled in such a way that the ratio Vw/Vr is in the range $0.99 \leq Vw/Vr \leq 1.07$ in at least in the last stage (the fifth horizontal rolling unit 55) or the one stage before the last stage (the fifth vertical rolling unit 45) as shown in FIG. 4, Vw being the traveling speed of the work material to be rolled 22 and Vr being the tangential velocity at the processing point P of the vertical mill roll 48 and the horizontal mill roll 58. The travelling speed Vw of the work material to be rolled 22 is calculated from the formula $Vw=Vf\times(S/Sf)$ by: obtaining the speed Vf and the cross-sectional area Sf of the work material to be rolled 22 output from the continuous rolling device E; and designating the cross-sectional area of the work material to be rolled 22 at each of the rolling units 40, 50 to be S.

The rolling temperature at the fifth horizontal rolling unit 55, which is located to the most product outlet side 33, is set to 500° C. or higher.

The copper wire rod 60 output from the product outlet 33 is subjected to cleaning and cooling in the cleaning and cooling device 15. Then, the flaws (defects) are detected by the flaw detector 16. The copper wire rod 60 free of quality problem is then reeled by the coiler F.

The copper wire rod 60 of the present embodiment is subjected to drawing working to be the fine wire with the diameter of 0.5-3.2 mm. Then, the fine wire is processed to be the drawn wire material with the flat plate square shape by flat processing (Wire Drawing Step S6). Then, enamel coating is applied on the outer circumference of the drawn wire material to be the magnet wire 70, on which the enamel coat 72 (insulating film) is formed (Enamel Coat Forming Step S7). The magnet wire 70 is reeled on the core rod material to form the coil, and used for a coil of a motor for example.

In the copper wire rod 60, which is related to the present embodiment, configured as explained above, the P content is set to more than 10 ppm by weight and 30 ppm by mass or less; hydrogen concentration after performing the heat treatment at 500° C. for 30 minutes in vacuum is 0.2 ppm by mass or less. Thus, formation of the surface defects in the copper wire rod 60 is suppressed; and the surface quality is improved.

That is, generation of $H_2O$ (water vapor) is suppressed due to fixation of O in the molten metal by: setting the O content to 10 ppm by mass or less; and adding P to more than 10 ppm by mass and 30 ppm by mass or less during casting of continuous casting and rolling. As a result, a large number of free hydrogen exists; and holes generated during casting can be effectively suppressed. When the heat treatment is performed at 500° C. for 30 minutes in vacuum to the copper wire rod, the above-described free-hydrogen is released to the outside of the copper wire rod; and the hydrogen concentration in the copper wire rod becomes 0.2 ppm by mass or less. In other words, if hydrogen existed in the copper wire rod as $H_2O$, the hydrogen concentration would become more than 0.2 ppm by mass even after performing the heat treatment at 500° C. for 30 minutes in vacuum.

Therefore, in the copper wire rod 60, in which the hydrogen concentration is 0.2 ppm by mass or less after performing the heat treatment at 500° C. for 30 minutes in vacuum, there is no hydrogen as $H_2O$. Thus, hole-generation during casting is suppressed, and there are less surface defects in the copper wire rod. Because of the reason described above, the surface quality of the copper wire rod is improved.

In addition, the magnet wire 70 related to the present invention includes the drawn wire material 71 produced by using the copper wire rod 60 with the excellent surface quality as explained above. When the surface quality of the copper wire rod 60 is excellent, the formation of the surface defects on the drawn wire material 71 can be suppressed to improve the surface quality. Thus, formation of blister defects on the magnet wire 70 can be suppressed.

According to the method of producing the copper wire rod of the present embodiment, the ratio Vw/Vr is set in the range $0.99 \leq Vw/Vr \leq 1.07$ in at least in the last stage (the fifth horizontal rolling unit 55) or the one stage before the last stage (the fifth vertical rolling unit 45), Vw being the traveling speed of the work material to be rolled 22 and Vr being the tangential velocity at the processing point P of the vertical mill roll 48 and the horizontal mill roll 58. Thus, the difference of speeds between: the work material to be rolled 22; and the vertical mill roll 48 and the horizontal mill roll 58, becomes less, enabling to suppress application of tensile force due to the above-described speed difference on the surface of the work material to be rolled 22 and the copper wire rod 60.

Because of the reason described above, the <111> texture or the <112> texture formed by the tensile force does not formed on the surface of the work material to be rolled 22 and the copper wire rod 60; and the acceptable surface workability of the copper wire rod 60 can be obtained. Therefore, formation of surface defects on the drawn wire material 71 can be suppressed even if the drawn wire material 71 with the intended wire diameter is produced by performing drawing working to the copper wire rod 60.

Furthermore, according to the method of producing the copper wire rod of the present embodiment, appearance of the <111> texture on the surface of the produced copper wire rod 60 can be suppressed; and the workability of the copper wire rod 60 can be improved, since the rolling temperature at the fifth horizontal rolling unit 55, which is located to the most product outlet side 33, is set to 500° C. or higher.

In addition, the copper wire rod 60 is preferably fully softened by annealing after cold working with cross-section reduction rate of 20% or more. In this copper wire rod 60, crystals, <111> orientations of which are oriented within the range of ±10° with respect to the drawing direction of the copper wire, is preferably 30% or less of the all crystals in the cross-section perpendicular to the drawing direction of the copper wire. Thus, by performing the heat treatment for full softening in the mid-flow of the drawing working, the crystals can be rotated during subsequent drawing working. Therefore, formation of surface defects can be suppressed.

In addition, preferably, the produced copper wire rod 60 is fully softened after working with the cross-section reduction rate of 20% or more. In the crystal orientations of this copper wire rod 60, it is preferable that: the crystals, <100> orientations of which are oriented within the range of +10° with respect to the drawing direction of the copper wire, is 10% or more of the all crystals; and the crystals, <111> orientations or <112> orientations of which are oriented within the range of ±10° with respect to the drawing direction, is 30% or less of the all crystals. Thus, by performing the heat treatment for full softening in the mid-flow of the drawing working, the crystals can be rotated during subsequent drawing working. Therefore, formation of surface defects can be suppressed.

Also, in the continuous casting step S4, the belt-wheel type continuous casting apparatus D is used. The belt-wheel type continuous casting apparatus D includes the casting wheel 13 in which a groove if formed in the wheel's outer circumference; and the endless belt 14. In using the belt-wheel type continuous casting apparatus D, the long length ingot 21 is obtained by pouring the molten copper into the space (mold) sectionally-formed by the groove and the endless belt 14. Therefore, the copper wire rod 60 can be produced efficiently at a low cost.

In addition, in the present embodiment, the temperature of the molten metal during casting in the continuous casting and rolling is set to 1085° C. or higher and 1115° C. or lower. Thus, the degree of solubility of hydrogen in the molten material is lowered; and the holes generated during solidification can be reduced. Therefore, formation of surface defects on the copper wire rod can be suppressed.

The embodiments of the present invention are explained above. However, the present invention is not limited by the description of the embodiments and can be modified appropriately as long as within the scope of the technical concept of the present invention. For example, the continuous rolling device with 5 sets of the vertical rolling units and 5 sets of the horizontal rolling units is explained. However, the present invention is not particularly limited by the configuration. Thus, the numbers and/or arrangement of the rolling units can be appropriately set differently.

In the above-described embodiment, the copper wire rod is produced by using the 4N electrolytic copper cathode as the material to be melted. However, the present invention is not particularly limited by the description. Thus, the copper wire rod can be produced from raw material such as scrap.

In addition, there is no limitation on the cross-sectional shape and/or the size of the long length ingot. Similarly, the wire diameter of the copper wire rod is not limited by the description of the embodiments.

Also, the case where the drawn wire material is the rectangular wire is explained in the present embodiment. However, the drawn wire material can be a round wire or a rolled round wire material.

Furthermore, a twin-belt casting apparatus can be used too in the continuous casting process even though it is described that the belt-wheel type continuous casting apparatus is used in the embodiments.

EXAMPLES

Results of the confirmation tests, which were performed for confirming the effectiveness of the present invention, are explained below. For the confirmation tests, the copper wire rods (wire diameter: 8.0 mm) of Example 1 to Example 5 of the present invention; and Comparative Example 1 to Comparative Example 3, were prepared by using the copper wire rod producing apparatus described in the above-described embodiments.

After the preparation of the copper wire rods, P, O, and H contents; and electrical conductivity, of the copper wire rods were measured.

The P content was measured by the spark discharge-emission spectrometric analysis by using the model ARL4460 manufactured by Thermo Fisher Scientific Inc.

The O content was measured by the inert gas fusion infrared adsorption method by using the oxygen determinator (model: RO-600) manufactured by LECO Co.

The H content was measured by the inert gas fusion gas chromatography-separated thermal conductivity measurement method by using the hydrogen determinator (model: RHEN-600) manufactured by LECO Co. In the analysis with the hydrogen determinator (RHEN-600), the lower limit of quantification of the method is 0.2 ppm by mass.

The electrical conductivity was measured by the double bridge method by using the Precision Double Bridge manufactured by Yokogawa Electric Co.

Next, the obtained copper wire rods were polished by a piece of #2400 water-resistant paper. Then, electro-polishing was performed on the copper wire rods using electric polishing liquid in which phosphoric acid and water are mixed in the ratio of 1:1. Then, they were cleaned by water and ethanol. Then, after performing the heat treatment at 500° C. for 30 minutes in vacuum of $1\times10^{-10}$ Torr, the hydrogen concentrations of the copper wire rods were measured by the inert gas fusion gas chromatography-separated thermal conductivity measurement method.

Next, the drawn wire materials with the wire diameter of 2.6 mm were produced by performing cold drawing process to the obtained copper wire rods.

By detecting surface defects on the drawn wire materials obtained as described above by visual inspection; and touch inspection using a stocking, the number of surface defects per 100 kg of the drawn wire material was counted.

The results of the above-mentioned measurements are shown in Table 1.

TABLE 1

| | Composition of the copper wire rod | | | | Hydrogen concentration | | Electrical |
|---|---|---|---|---|---|---|---|
| | P (ppm by mass) | O (ppm by mass) | H (ppm by mass) | Balance | after heat treatment (ppm by mass) | Number of surface defects | conductivity (% IACS) |
| Example 1 of the present invention | 11 | 5 | 0.4 | Copper and inevitable impurities | <0.2 | 0 | 102 |
| Example 2 of the present invention | 15 | 9 | 0.3 | Copper and inevitable impurities | <0.2 | 1 | 101 |

TABLE 1-continued

| | Composition of the copper wire rod | | | | Hydrogen concentration | | Electrical |
|---|---|---|---|---|---|---|---|
| | P (ppm by mass) | O (ppm by mass) | H (ppm by mass) | Balance | after heat treatment (ppm by mass) | Number of surface defects | conductivity (% IACS) |
| Example 3 of the present invention | 21 | 3 | 0.6 | Copper and inevitable impurities | <0.2 | 3 | 101 |
| Example 4 of the present invention | 25 | 4 | 0.6 | Copper and inevitable impurities | <0.2 | 0 | 101 |
| Example 5 of the present invention | 28 | 5 | 0.5 | Copper and inevitable impurities | <0.2 | 2 | 101 |
| Comparative Example 1 | 2 | 5 | 0.6 | Copper and inevitable impurities | 0.5 | 22 | 102 |
| Comparative Example 2 | 60 | 3 | 0.8 | Copper and inevitable impurities | <0.2 | 1 | 96 |
| Comparative Example 3 | 20 | 8 | 1.3 | Copper and inevitable impurities | 0.4 | 15 | 101 |

As shown in Table 1, it was confirmed that there were only a small number of surface defects on the drawn wire materials in Examples 1 to 5 of the present invention, since the P contents in the copper wire rods were within the range more than 10 ppm by mass and 30 ppm by mass or less; and the hydrogen concentrations in the copper wire rods after the heat treatment were less than 0.2 ppm by mass, which was the lower limit of quantification of the method. In addition, it was confirmed that high electrical conductivity was obtained in Examples 1 to 5 of the present invention.

Contrary to that, there were a large number of surface defects on the drawn wire material in Comparative Example 1, since the hydrogen concentration after the heat treatment was more than 0.2 ppm by mass due to the P content in the copper wire rod being 10 ppm by mass or less.

In Comparative Example 2, electrical conductivity was inferior to electrical conductivity of the copper wire rods in Examples 1 to 5 of the present invention since the P content of the copper wire rod in Comparative Example 2 is more than 30 ppm by mass.

In Comparative Example 3, there were a large number of surface defects in Comparative Example 3, since the H content in the copper wire rod was more than 1 ppm by mass; and the hydrogen concentration after the heat treatment was more than 0.2 ppm by mass.

INDUSTRIAL APPLICABILITY

A copper wire rod with an excellent surface quality can be produced at low cost.

BRIEF DESCRIPTION OF THE REFERENCE SYMBOLS

60: Copper wire rod
70: Magnet wire
71: Drawn wire material
72: Enamel coat (insulating film)

The invention claimed is:

1. A copper wire rod produced by continuous casting and rolling, the copper wire rod made of a composition consisting of:

more than 10 ppm by mass and 30 ppm by mass or less of P;

10 ppm by mass or less of O;

1 ppm by mass or less of H; and the Cu balance and inevitable impurities, wherein when a heat treatment is performed on the copper wire rod at 500° C. for 30 minutes in vacuum, the concentration of the H (hydrogen) becomes 0.2 ppm by mass or less, an electrical conductivity of the copper wire rod is 100% IACS or more, and crystals, <111> orientations of which are oriented within a range of ±10° with respect to a drawing direction of the copper wire, are 30% or less of all crystals in a cross-section perpendicular to the drawing direction of the copper wire, the copper wire rod being fully softened by annealing after cold working with cross-section reduction rate of 20% or more.

2. The copper wire rod according to claim 1, wherein crystals, <100> orientations of which are oriented within a range of ±10° with respect to the drawing direction of the copper wire, is 10% or more of all crystals; and crystals, <111> orientations or <112> orientations of which are oriented within a range of ±10° with respect to the drawing direction, are 30% or less of the all crystals.

3. A magnet wire comprising:

a drawn wire material produced by using the copper wire rod according to claim 1; and an insulating film coating an outer peripheral of the drawn wire material.

* * * * *